US005544920A

United States Patent [19]

Lanzarin

[11] Patent Number: 5,544,920

[45] Date of Patent: Aug. 13, 1996

[54] DEVICE WITH SHAPED HEAD FOR THE INTRODUCTION OF SPRINGS CAPABLE OF HOOKING BROCHURES AND PAMPHLETS WITHIN A CONTAINER

[75] Inventor: Giuseppe Lanzarin, Vicenza, Italy

[73] Assignee: Cartotecnica Montebello, s.r.l., Strada Provinciale della Favorita Sarego, Italy

[21] Appl. No.: 262,269

[22] Filed: Jun. 20, 1994

[30] Foreign Application Priority Data

Jul. 9, 1993 [IT] Italy ..... VI93A0120

[51] Int. Cl.[6] ..... B42F 11/02

[52] U.S. Cl. ..... 281/46; 281/45; 402/8

[58] Field of Search ..... 281/46, 45, 28, 281/21.1; 402/506, 502; 206/232, 425, 470, 472, 473, 483

[56] References Cited

U.S. PATENT DOCUMENTS

| | | | |
|---|---|---|---|
| 1,187,420 | 6/1916 | Edwards | 281/46 |
| 1,454,182 | 5/1923 | Myer | 281/46 |
| 2,981,259 | 4/1961 | Smith et al. | 281/46 |
| 3,596,928 | 8/1971 | Edmonds | 281/46 |
| 5,040,216 | 8/1991 | Policht | 281/46 |
| 5,186,496 | 2/1993 | Seki | 281/46 |
| 5,248,165 | 9/1993 | Lanzarin | 281/46 |

FOREIGN PATENT DOCUMENTS

| | | | |
|---|---|---|---|
| 518398 | 12/1992 | European Pat. Off. | 281/46 |
| 518389 | 2/1940 | United Kingdom | 281/46 |
| 1230256 | 4/1971 | United Kingdom | 281/46 |
| 1367106 | 9/1974 | United Kingdom | 281/46 |
| 2242866 | 10/1991 | United Kingdom | 281/46 |

*Primary Examiner*—Frances Han
*Attorney, Agent, or Firm*—Bucknam and Archer

[57] ABSTRACT

The device comprises two small plates (3 and 4) which may be planar or shaped to acquire a curved shape depending upon the type of the container to which they are applied, the two plates having a projecting segment at the end (5 and 6) on top of which are inserted the small springs (9). The springs hold the brochures and/or pamphlets in the container because there is provided a border (7) which prevents the exit of the springs when this exit would be undesirable and the exit should only occur after a deformation caused manually by the operator who may desire to unhook a pamphlet or brochure from the container.

3 Claims, 3 Drawing Sheets

DEVICE WITH SHAPED HEAD FOR THE INTRODUCTION OF SPRINGS CAPABLE OF HOOKING BROCHURES AND PAMPHLETS WITHIN A CONTAINER

FIELD OF THE INVENTION

The present invention relates to devices for holding brochures and pamphlets in containers.

BACKGROUND OF THE INVENTION

It is known that devices have been used by means of which brochures and the like containing documents may be held in a container while the individual who uses the container performs the task of inserting the brochures and pamphlets within the container. For instance, British 2,242,866 provides a device constituted by a plate, the plate being provided with lateral borders and two small plates parallel to the base plate and formed at the ends of the base plate. The two small plates are directed towards the interior of the container where the base plate is fixed for the purpose of permitting the introduction of suitably shaped, elastic pins by means of which the brochures and pamphlets are held attached to the container.

Another type of device to hold the brochures in the containers has been proposed by the applicant as in the present application in Italian Patent Application No. VI 91 U 000060. The device according to this patent application comprises two shaped small plates which are fixed to the interior surface of the rib of the container. Each small plate is provided with a part which projects at right angle and orifices are made in this part, with pins being inserted in the orifices to hold the brochures or pamphlets in the containers.

SUMMARY OF THE INVENTION

One object of the present invention is to provide a device having a shaped head, capable of permitting the introduction of springs, the springs having a particular shape, by means of which the pamphlets and brochures being inserted in the container are hooked.

The present invention provides a device which has been improved, the device being applied to the internal surface of the back of the container. The essential novel feature of the invention resides in the fact that it comprises two shaped small plates being applied to the opposite ends of the same border, the small plates being provided with a portion projecting at the end. The springs are shaped in the form of a "U" and are inserted under the projecting portion. The springs have sides of essentially identical length. The springs permit the end of the brochure or pamphlet to be hooked. The device further comprises a safety bar which is located at the ends of the small plate so that disengagement of the springs from the small plate is impossible unless the operator deliberately performs the suitable maneuver.

Naturally, the possibility is provided that the small plates being fixed to the internal surface of the back of the container may be planar or curved depending upon the particular shape of the same back of the container.

The invention will be described hereinbelow by reference to the accompanying drawings of which:

FIG. 1 is an overall view of the internal surface of the container in the open position with two small plates being fixed at the ends of the container, the plates having a variable size according to the specific requirements. A predetermined number of springs is located on the border of the container, the springs being capable of being separated and being introduced into the small shaped plates with an easy manual operation which is carried out by the operator who has bought the container;

Figure 1:
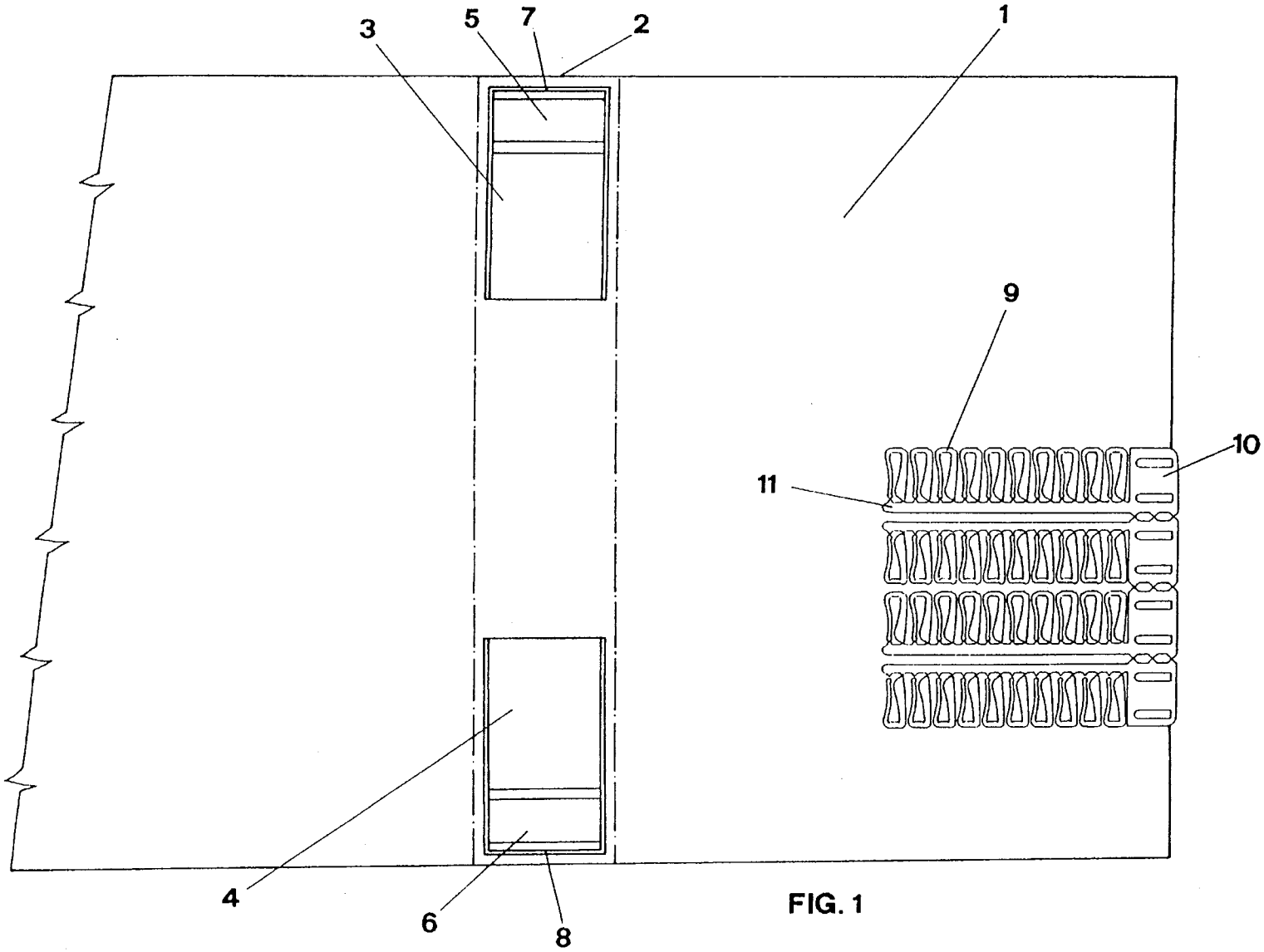

As shown in FIG. 1, the container (1) comprises the dorsal plate (2) which may have a planar or curved shape. In the interior of the plate (2) are fixed, for instance by gluing or soldering, easily obtained in plastic material, the two small plates (3) and (4) which are suitably shaped with connecting members (5) and (6) which protrude from the internal surface of the dorsal plate (2) and the two bars (7) and (8) at the extremities. These bars prevent the exit of the springs (9) being introduced in the device in order to hook the brochures which must be kept in the interior of the container (1).

Obviously, the predetermined number of springs (9) are placed on a suitable plate (10) which is hooked to the border of the container and the springs (9) may be easily detached from bars (11) which are integral with plate (10). The same operator may detach them at the time when he introduces the brochures and pamphlets within the container.

Figure 2:
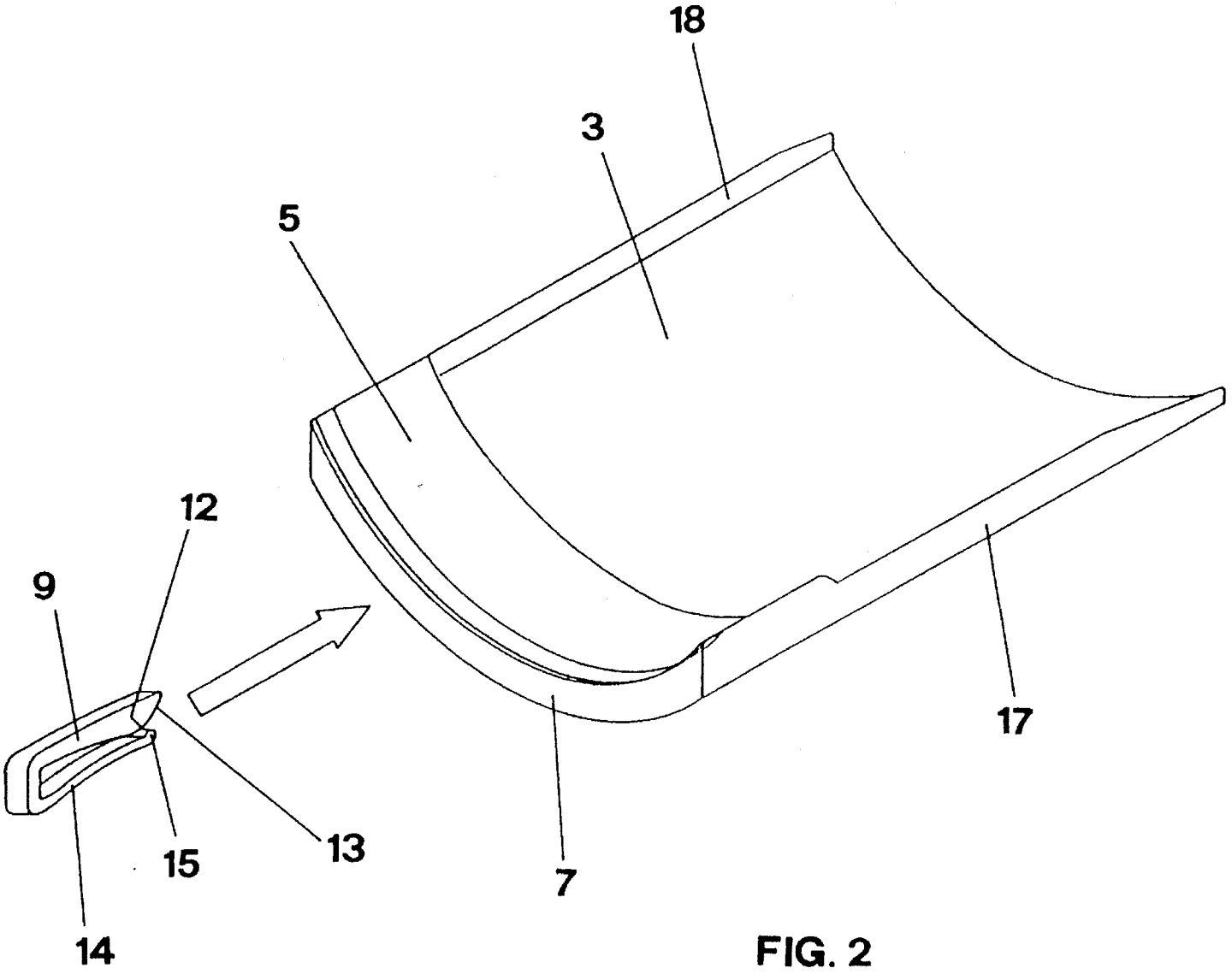
FIG. 2 is a perspective view of one of the shaped plates being used at the head of the container, which in this case, has a curved shape, within which are introduced the small springs capable of holding the pamphlets and brochures in the container.

FIG. 2 is a perspective view of plate (3) which in this case has a curved shape and is provided with connecting member (5) within which is introduced spring (9) shaped in the form of a "U" and capable of retaining the brochure which must be introduced into the container.

At the head of plate (3) is located the extremity bar (7) which makes esentially impossible the detachment of spring (9) from the portion (5) of plate (3) after the brochure or pamphlet has been introduced into the container.

It should be noted that the spring (9) is shaped so as to present on the side which is introduced into the brochure a suitable projection (12) which is curved and which ends in the inclined plane (13). The latter facilitates the introduction of the spring in the brochure while the opposite side (14) which must be inserted under the connecting member (5) of the small plate (3) has a curved shape and ends with a small projection (15) which is disposed at the end and which is directed towards the interior.

The operation of the insertion of spring (9) under the connecting piece (5) of plate (3) is better visible in FIGS. 3 through 6.

Figure 3:
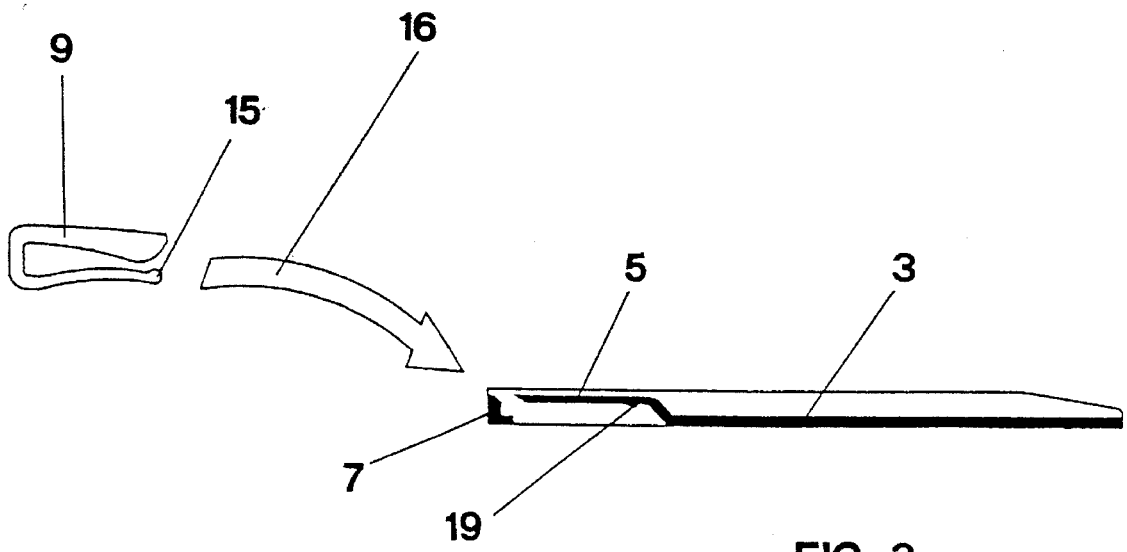
FIG. 3 is a longitudinal view of the shaped plate with one spring capable of being introduced into the plate.

In particular, FIG. 3 shows the spring (9) substantially away from plate (3) to which it will become closer according to the direction of arrow (16).

Figure 4:
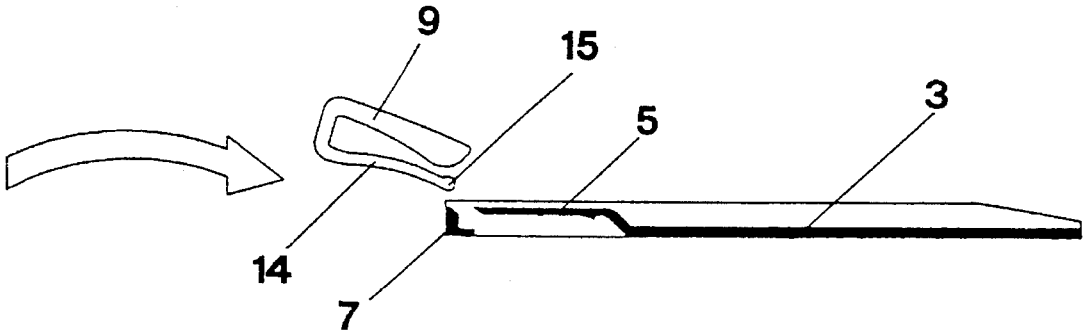
FIG. 4 illustrates the same plate with the spring located in proximity of the plate.

FIG. 4 shows the spring (9) close to the plate (3) in such a manner as to present the lower part (14) a little above tie (7), the latter closing the plate (3) in the upper part.

Figure 5:
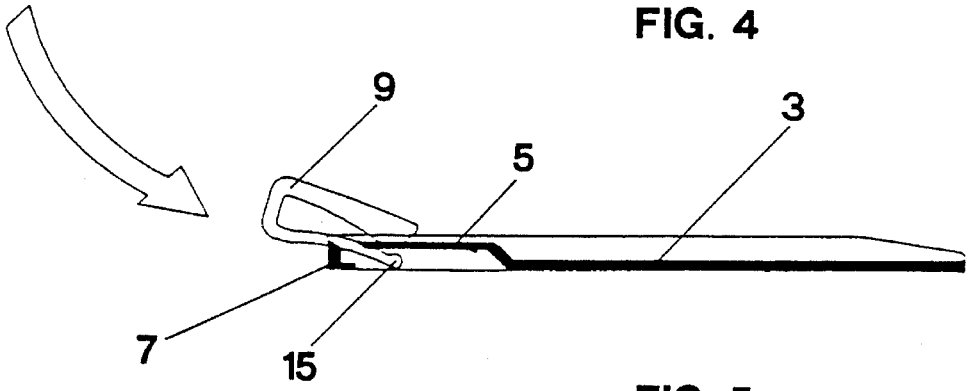
FIG. 5 illustrates the same plate with the spring partially inserted into the plate.
Figure 6:
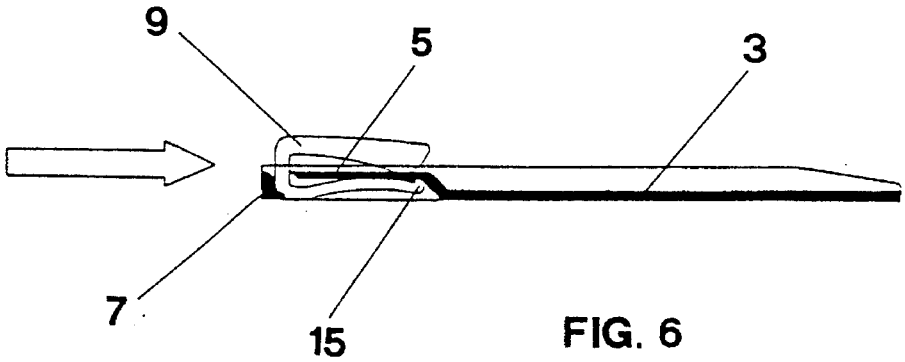
FIG. 6 illustrates the same plate with the spring fully inserted into the plate.

The wing (14) is introduced into the space comprised between tie (7) and the border of the connecting member (5) of plate (3) in such a manner to be introduced within the latter as shown in FIG. 5 to be disposed in the final position which is visible in FIG. 6 taking advantage of the elasticity of the material of which spring (9) is made.

In this position, the spring will be held firmly by tie (7) and it will not be possible to detach it except by a deformation obtained by a manual operation on the part of the operator who wishes to remove the brochure from the container.

FIG. 2 shows that the borders (17) and (18) formed on the small plate (3) serve the purpose of providing a greater stability to the plate while the projection (15) formed on the spring (9), after the spring has been inserted in plate (3), hooks itself to the corresponding projection (19) shown in FIG. 3, formed on the interior surface of the connecting member (5) for the purpose of ensuring a greater stability against the rotation of spring (9). In this manner greater stability is obtained in holding the pamphlets or brochures within the container while at the same time it is possible with a simple manual operation to carry out the operation of hooking the brochures or pamphlets within the container as well as the opposite operation of removing the brochures or pamphlets from the container.

The advantages according to the present invention are evident because they provide stability in holding the brochures within the container and at the same time the brochures may be inserted or removed from the container with ease and while the location in the lateral direction is not limited. Further the invention is advantageous because it is very economical with respect to the cost of manufacture.

It should also be noted that the overall view of the container together with the brochures or pamphlets inserted therein is attractive because it assumes the shape of a bound book.

What is claimed is:

1. A device for introducing springs into a container (1), said springs hooking pamphlets, brochures and the like within said container, said container having a back, a dorsal plate (2), said dorsal plate (2) having an interior, which comprises two small plates (3) and (4) fixed to said interior of said dorsal plate (2), each of said small plates having lateral borders (17) and (18), said small plates (3) and (4) having projecting shaped connecting members (5) and (6), and bars (7) and (8), each of said connecting members (5) and (6) having an extremity, each of said bars (7) and (8) protruding from each of said extremity, said shaped connecting members emerging from said interior of said dorsal plate (2), the device comprising a plurality of springs (9), each of said springs having a U-shape, a lower part (14) and an upper part (12), said lower part having an end, a projection (15) at the end of said lower part (14), said upper part (12) having a curved end (13), each of said curved end (13) of each spring being introduced into each of said pamphlets and brochures, and being held above each of said connecting members (5) and (6), each of said connecting members having a protruding border (19), said projection (15) hooking to said protruding border (19), wherein each of said small plates (3) and (4) has a plane, each of said connecting members (5) and (6) of said plates (3) and (4) is raised with respect to said plane of each of said plates (3) and (4) and said lower part (14) of each of said springs is inserted under each of said connecting members and is held between each of said bars (7) and (8) and said connecting members, and wherein the device comprises rods (11), said container has a border, a third plate (10) is hooked to said border, said rods (11) are integral with said third plate (10), said springs being placed on said third plate, said springs (9) are fixed to said rods (11) and each of said springs (9) is removable from said rods (11) in order to insert each of said springs within one of said plates (3) and (4).

2. The device according to claim 1 wherein said plates (3) and (4) are planar.

3. The device according to claim 1 wherein said plates (3) and (4) are curved.

* * * * *